United States Patent [19]

Malamoud

[11] 4,307,824

[45] Dec. 29, 1981

[54] WATCHBAND ATTACHMENT TO A WRISTWATCH

[75] Inventor: Jean G. Malamoud, Saint-Jorioz, France

[73] Assignee: S. T. Dupont, Paris, France

[21] Appl. No.: 154,659

[22] Filed: May 30, 1980

[51] Int. Cl.[3] ..... G04B 37/00

[52] U.S. Cl. ..... 224/164; 224/177

[58] Field of Search ..... 224/164, 150, 166, 175, 224/176, 177, 178, 179, 180, 903

[56] References Cited

U.S. PATENT DOCUMENTS

| | | | |
|---|---|---|---|
| 1,227,598 | 5/1917 | Ellis | 224/177 X |
| 2,191,020 | 2/1940 | Kaufmann | 224/177 |
| 3,165,884 | 1/1965 | Gwinner et al. | 224/164 X |
| 3,968,643 | 7/1976 | Curtil | 224/179 X |

FOREIGN PATENT DOCUMENTS

| | | |
|---|---|---|
| 1746986 | 4/1957 | Fed. Rep. of Germany . |
| 123764 | 12/1927 | Switzerland . |

*Primary Examiner*—Steven M. Pollard

*Attorney, Agent, or Firm*—Mandel E. Slater; Leonard J. Janowski

[57] ABSTRACT

Watchband attachment to a wristwatch is described in which support structure having a pin mounted thereon is connected to the watch case. An end of the watchband is wrapped around the pin and includes a slot for passage of the support structure, which includes a channel between the pin and the watch case for passage of the watchband.

6 Claims, 9 Drawing Figures

WATCHBAND ATTACHMENT TO A WRISTWATCH

BACKGROUND OF THE INVENTION

1. Field of the Invention

The present invention relates to improvements in means for attaching a watchband to a wristwatch.

2. Description of the Prior Art

In most wristwatches including a watchband, each end of the band is wound around a pin attached to twin spaced-apart supports connected to the case. The presence of these two supports on the case imposes a number of limitations on the aesthetic design of wristwatches. Accordingly it has been considered desirable to find a means for concealing these supports and, in general, any band-fastening device, in order to improve upon the aesthetic appearance of a wristwatch and band.

Thus, in Swiss Pat. No. 123,764 (Gerber), a wristwatch is proposed (FIGS. 1 and 2) with case 1 equipped with a T-shaped band-fastening part 2. This part is mounted on the watch case by it central member 3. Watchband 4 is wrapped around two side arms 5 of the band-fastening part and for this purpose has a slot 6 providing a passage for the central member. When watchband 4 is disposed in the plane of the case, it conceals T-shaped fastening part 2. However, when it is inclined with respect to the plane of the watch, as shown in FIG. 1, which is generally the case when the watch is being worn on the wrist, slot 6 and the corresponding support part are visible.

SUMMARY OF THE INVENTION

Accordingly the principal object of the present invention is to overcome the above disadvantage by providing means for concealing the watch-fastening system from the eyes of the wearer, even when the watchband is inclined with respect to the plane of the watch case.

With the above object in view, a feature of the present invention is a watchband attachment to a wristwatch wherein the wristwatch includes a case having support structure connected thereto and a pin mounted on the support structure. The watchband includes an end wrapped around the pin and a slot for passage of the support structure, and the latter includes a channel disposed between the pin and the case for passage of the watchband.

In one particularly attractive embodiment of the invention, the support structure includes a base extending further from the case than the pin, in order, as will be explained more fully below, to permit the length of said slot to be decreased in order to increase the degree of inclination the watchband may assume without revealing the slot and support structure visible therethrough. This arrangement also enables the contact surface between the support structure and the watchband to be increased and hence the holding ability of the latter to be improved.

In another particularly attractive embodiment of the invention, the watch case is provided with a generally arcuate cavity substantially matching or complementary to the shape of the watchband. This arrangement makes it possible for the part of the watchband having the slot to be masked from view with the aid of the case, and enables the inclination the watchband may assume to be increased without revealing the slot. It also improves the holding ability of the watchband.

BRIEF DESCRIPTION OF THE DRAWING

The above and other features of the invention will become apparent from the following description and claims, with reference to the accompanying drawing, in which:

DESCRIPTION OF THE PREFERRED EMBODIMENTS

Figure 1:
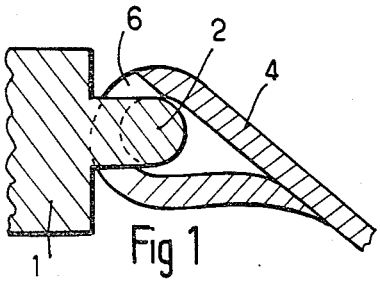
FIG. 1 is a partial sectional view through a wristwatch of a known type.
Figure 3:
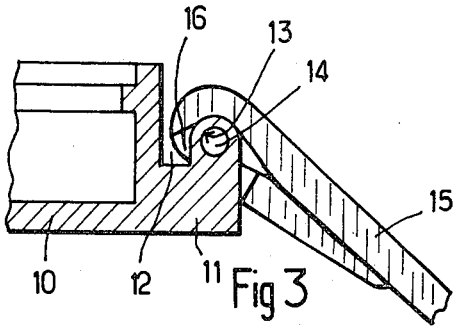
FIG. 3 is a partial sectional view through a wristwatch according to the present invention.
Figure 2:
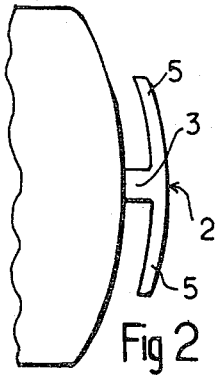
FIG. 2 is a top view on a reduced scale of the case of the wristwatch of FIG. 1, before attachment of the watchband.
Figure 6:
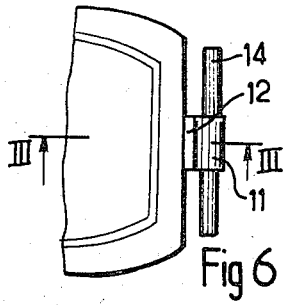
FIGS. 6 and 7 are top plan views on a reduced scale of the watches of FIGS. 3 and 4, respectively, before the watchband has been fitted to the watch.

Referring to the drawing, in FIGS. 3 and 6 it will be seen that each side of case 10 of the watch is provided with a support 11 having a base portion integral with case 10 and an upper part which is separated from the case by a channel 12. The support is provided with a hole 13 into which a pin 14 is force-fitted. A leather watchband 15 is wrapped around pin 14 and support 11. For this purpose watchband 15 is provided with a slot 16 allowing support 11 to pass through, and the band is sufficiently wide at its end so that the pin does not protrude therefrom. By contrast with known wristwatches (shown schematically in FIGS. 1 and 2) and as shown in FIG. 3, it is possible to incline watchband 15 with respect to the case without revealing slot 16 to view. Thus, when the watch is in place on the wearer's wrist, the entire watchband fastening device is concealed by the watchband.

Figure 4:
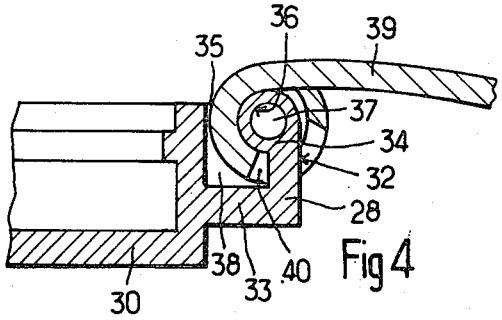
FIG. 4 is a partial sectional view through a wristwatch illustrative of a further embodiment of the invention.
Figure 7:
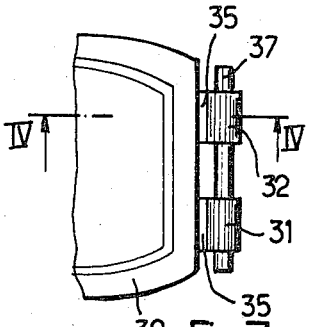

In FIGS. 4 and 7, each side of case 30 of the watch is provided with two supports 31,32. The supports include base portions 33 integral with case 30 and upper parts 34 separated from case 30 by a channel 35. The supports are each provided with holes 36 wherein a single pin 37 is force-fitted. Channel 35 includes a base portion 38 wider than the portion between case 30 and pin 37. A metal watchband 39 wider at its end than pin 37 is wrapped therearound and around supports 31,32. The band has two slots 40 adapted for passage of the supports 31,32. It will be seen that widening base portion 38 of channel 35 allows the length of slots 40 to be decreased and the inclination that can be conferred on the watchband with respect to the surface of the watch case to be increased without revealing the slots 40. This also enables the contact surface between supports 31 and 32 and watchband 39 to be increased and the holding ability of the latter to be improved.

Figure 5:
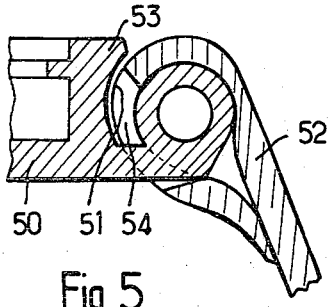
FIG. 5 is a partial sectional view through a wristwatch illustrative of yet another embodiment of the invention.

As shown in FIG. 5, case 50 can be shaped such as to provide channel 51 of generally arcuate shape, thus enabling watchband 52 to fit into the channel so that the upper angled portion 53 of the case masks the part of the watchband located immediately below, which part is provided with slot 54. This arrangement enables the inclination that can be conferred thereon to be increased without revealing slot 54. The holding ability of the watchband is improved in this way, since the watchband is guided on both sides of the two complementary walls of channel 51.

Figure 8:
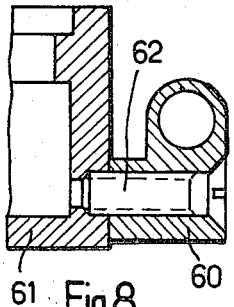
FIG. 8 is a partial sectional view through a watch according to a still further embodiment of the invention.

Also, as shown in FIG. 8, a support 60 not integral with case 61, but fastened thereto by a fastening means such as a screw 62, can be used.

Figure 9:
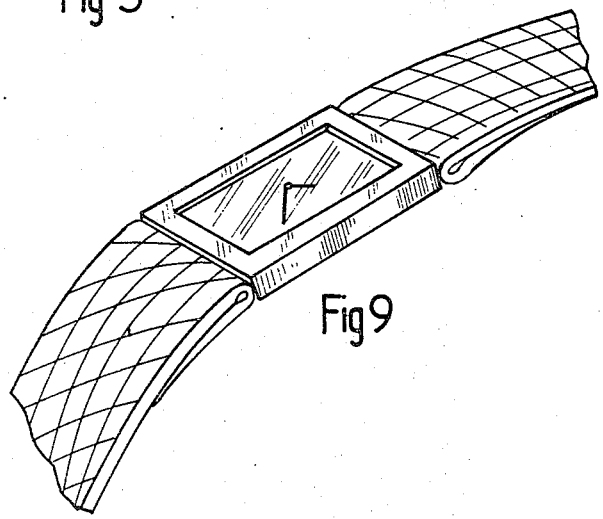
FIG. 9 is a perspective view of a wristwatch according to the invention.

In FIG. 9 can be seen the overall aesthetically pleasing appearance in a watchband attachment to a wristwatch utilizing the features of the present invention.

While various aspects of the invention have been illustrated by the foregoing detailed embodiments, it is to be understood that various substitutions of equivalents may be made without departing from the spirit and scope of the invention.

What is claimed is:

1. In a watchband attachment to a wristwatch wherein said wristwatch includes a case having support structure including pin mounting means connected thereto and a pin secured in said pin mounting means, said watchband including an end wrapped around said pin and a slot adapted for passage of said support structure therethrough, the improvement in which said support structure includes a portion disposed below the level of said pin to define a channel between said pin mounting means and said case for passage of said watchband.

2. The invention according to claim 1, in which the width of the support structure is less than the width of said end of said watchband.

3. The invention according to claim 1, in which said support structure includes a base extending further from said case than said pin.

4. The invention according to claim 1, in which said channel is of substantially arcuate configuration, substantially complementary to said watchband.

5. The invention according to any of claims 1 to 3, in which said support structure is integral with said case.

6. The invention according to any of claims 1 to 3, in which said support structure comprises a member separate from said case and rigidly locked thereto.

* * * * *